United States Patent [19]

Ruperto

[11] Patent Number: 4,502,690

[45] Date of Patent: Mar. 5, 1985

[54] JAI-ALAI CESTA

[76] Inventor: Winfred M. Ruperto, 47 El Camino Real, Burlingame, Calif. 94010

[21] Appl. No.: 464,157

[22] Filed: Feb. 7, 1983

[51] Int. Cl.[3] ..... A63B 59/02

[52] U.S. Cl. ..... 273/326

[58] Field of Search ..... 273/326, 322

[56] References Cited

U.S. PATENT DOCUMENTS

| | | | |
|---|---|---|---|
| 642,638 | 2/1900 | Smith | 273/326 |
| 1,022,186 | 4/1912 | Engler | 273/322 |
| 1,530,573 | 3/1925 | Olcott | 273/326 |
| 2,670,958 | 3/1954 | Leiser et al. | 273/326 |
| 2,710,753 | 6/1955 | Lockwood | 273/326 |
| 3,170,688 | 2/1965 | Porter | 273/326 X |
| 4,045,026 | 8/1977 | Gillespie et al. | 273/326 |
| 4,098,508 | 7/1978 | Gandy | 273/326 |
| 4,273,339 | 6/1981 | Fortunato | 273/326 |
| 4,374,590 | 2/1983 | Everlith et al. | 273/326 |

*Primary Examiner*—William H. Grieb

*Attorney, Agent, or Firm*—Allston L. Jones

[57] ABSTRACT

An article in the form of a long, narrow basket having a rounded "C" shaped interior bottom surface with an elongated lip portion at one end. The lip portion extends substantially perpendicular to the sides of the main portion of the basket with the portion furthest from the main portion of the basket being relatively flat with sides developing as the lip portion joins the remainder of the basket to blend the interior surface of the lip portion to that of the main portion of the basket without irregularities. The article also includes a long handle attached to the basket at the end opposite the lip portion, and a flexible hand securing means with adjustable finger slots.

23 Claims, 9 Drawing Figures

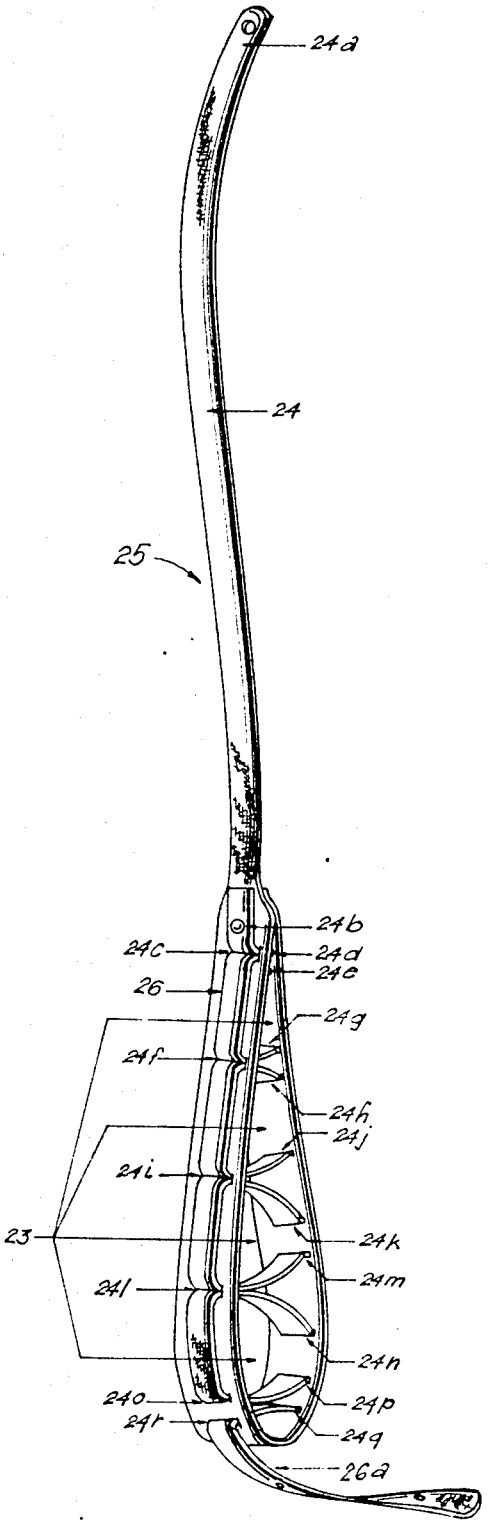
FIG. 9
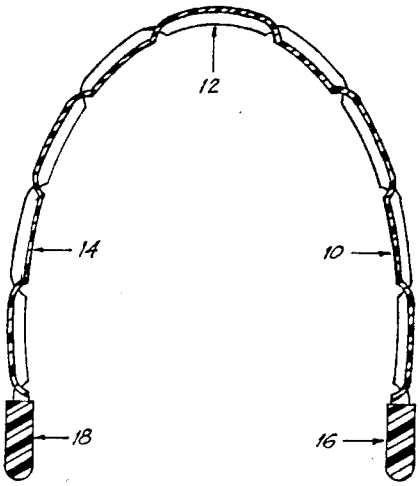
FIG. 5
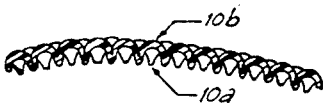
FIG. 6
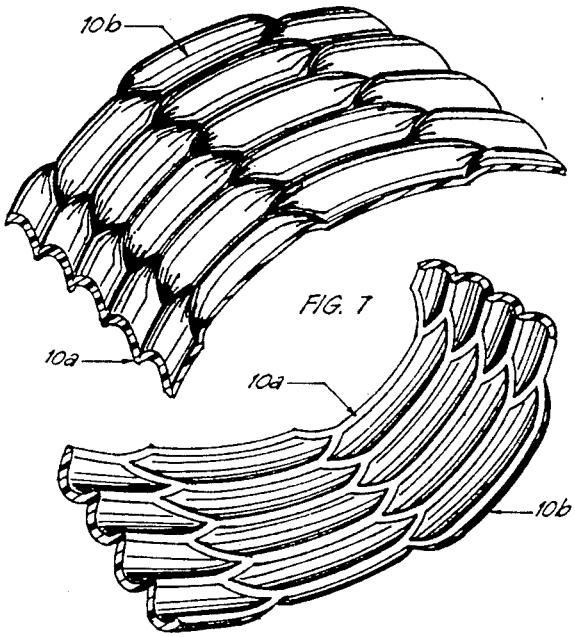
FIG. 7
FIG. 8

JAI-ALAI CESTA

BACKGROUND OF THE INVENTION

1. Field of the Invention

This invention relates to an improvement in the Jai-Alai Cesta which is a handheld device for throwing and catching a small hard ball as it caroms off a three-walled court.

2. Discussion of the Prior Art

Jai-Alai is a super fast version of the three-walled Handball whereby players use two-foot long curved wicker baskets called Cestas. Strapped to the player's arm, the cesta is used to catch a very hard lively ball as it comes off the wall and, in nearly the same movement, fling it back to the front wall for the opponent player to catch and throw back.

Heretofore, traditional Jai-Alai cestas are all expensively custom-made for each individual player's specifications and are handmade from imported reed strips and wood materials. They have a handglove portion, where normally, the right hand of a player is inserted and the wrist is strapped for the cesta's handling and control, and for preventing it from slipping off the arm in usage. Because of the unique shape of the traditional cesta and the position of the strapped hand spread flat on the surface of the glove portion, which is located at the back-end of the cesta, a player needs a finely synchronized arm swing and body motions to be able to catch and throw the hard ball properly. All novices in the game, who are adept in other sports at using rackets, like Tennis, Racquetball, Squash, etc., find it very difficult to get used to jai-alai and to learn the skill required to control and master the traditional cesta. Furthermore, it is much more difficult for them to gain the ability to impart a spin (english) to the ball, which is one of the novelty shots in the game. This is due to the very shallow ridges in the ball's pathway along the internal surface of the traditional cesta, defined by the thickness of the thin reed strips webbed across its wooden ribs. These ridges are less than 1/64th of an inch high. Considering that the hard ball's diameter is about 2 inches, there is just not enough mechanical means to provide the spin (english) on it in a novice's swing. A proficient player though, through experience, adds a snap of the wrist to his/her shots to effect the desired english. However, the new player has to spend a lot of time and hard training to be able to do this. Also, if catches are misplaced the player is exposed to a high risk of being hit by the speeding hard ball, travelling at approximately 150 miles per hour since the maximum distance of the ball-receiving area (scoop) from the player's body is only an arm's length during the catching action. This very poor margin of safety could, therefore, cause severe injury specially to new players just learning to position themselves correctly in the court.

The glove version of strapping the player's wrist to the traditional cesta has also these additional disadvantages:

(a) Since the game is fast paced and points are made in a matter of seconds, and the players normally rotate between their turns at play, the glove version is very inconvenient for the players who might need a quick rest and ventilation of their sweating playing hands. This is due to the considerable amount of time involved in removing the device and putting it back on.

(b) The standard cesta is fairly limited in its interchangeability between right-handed and left-handed persons, and is not readily adjustable to fit different sizes of hands.

(c) The permanent position of the hand in the glove portion of the standard cesta limits the variation of shots and catches available to the player.

(d) The strap (cesta) tightly wound around the player's wrist exerts a tremendous pressure on it during usage, impeding proper blood circulation in the player's arm causing pressure pains, cramps, and numbness to the hand.

(e) The lack of ventilation inside the glove portion creates profuse sweating of the hand.

U.S. Pat. No. 642,638 is an old version of the traditional cesta now widely used by Jai-Alai professional players. Two other similarly formed cestas are disclosed in U.S. Pat. Nos. 4,098,508 and 4,273,339, except that both of these disclosed devices are made of plastic material instead of the traditional reed strips and wooden materials. The general difference between these two is that the former incorporates a lining of a resilient material secured in the ball-receiving scoop to help absorb the impact of the ball and hopefully facilitate catching and preventing it from bouncing out of the cesta. Also, its hand-securing means is comprised of slots in the hand-receiving section whereby straps of flexible material are webbed through to form loops for securing each individual fingers of the player's hand to the glove section of the cesta. This is to facilitate the fitting of different sizes of players' hands. The problem in this design is that it is very complicated, needs a lot of different holes and slots in the cesta itself, and requires a number of different materials, making it very expensive to manufacture. Furthermore, although this loop version of finger attachment allows the playing hand to breathe and may well be adjustable to different sizes of hands, it is very uncomfortable to use since the loops exert a lot of localized pressure in the areas of the fingers and wrist where the loops rest, ultimately causing pressure pains. Also the strap (cesta) has not been well designed to be secure enough to counteract the tremendous centrifugal force that naturally develops in a player's swing or to prevent the cesta from flying off the player's arm.

On the other hand, the cesta of U.S. Pat. No. 4,273,339 is formed from a one-piece polystyrene material having outturned flanged portions in the edges of its ball-receiving scoop covered with slidable U-shaped plastic strip stiffeners serving as a brace, and a glove member including two rectangular cloth layers sewed together to provide finger openings. Control of the ball's path in throwing and catching it is very difficult in this cesta because of its smooth internal surface and it, definitely, has no capability to impart a spin (english) to the hard ball. Another is the "CESTA BALL" marketed by Brunswich which is similar to the device disclosed in U.S. Pat. No. 4,273,339 but smaller in dimension. Since each of these cestas necessitates a wrist strap (cestus) for securing the cesta to the player's arm, they, therefore, have all of the disadvantages of the traditional cesta discussed above which poses a big problem to jai-alai enthusiasts.

Several other versions of devices with handles used for throwing and catching projectiles are exemplified by U.S. Pat. No. 1,022,186, No. 1,530,573, No. 2,670,958, No. 2,710,753, No. 3,170,688, and No. 4,045,026.

There are also some toys patterned crudely after the Jai-Alai basket and LaCrosse stick, albeit in smaller dimensions. One of these is a toy made of molded polyethelene plastic with a plain solid surface resembling a miniature trough bent forward in an arc with a short cylindrical hollow handle at the bottom of one end. This end of the arc adjacent to the top of the handle, has a funnel-like pocket whose main functions are to block the ball's trajectory once inside it and to carry the ball for a length of time after catching it through the other end, which is open and serves, also, as the launching pad of the light plastic ball used with it.

Another toy trademarked "Jai-lite" has a Jai-Alai-like basket but without the long snout which forms the J-like figure of a traditional cesta. It is formed from a wire-sized wicker material woven together resembling a very narrow spoon. Instead of using a glove for securing it to the hand, it has a rectangular member made of the same wicker material, the ends of which are attached to the side braces of the basket, forming a sort of an arch or a bridge over the surface of the glove portion. The intention is to hold down the palm of the hand, which is supposed to be inserted inside this arch, and prevent it from slipping-off during usage, however, the size of the gap or slot created by this arch containing the hand is much too loose and unadjustable plus there are numerous sharp ends of the woven wicker at the web joints protruding on the surface which could easily injure a bare hand when it is inserted into this arch.

Another one of these toys is one whose basket is made up of several bowed rattan ribs which has been handcrafted to form a spoon-like scoop with a short cylindrical handle. However, like a LaCross stick, all of these devices are used specifically for catching and throwing mostly rubber or very light plastic balls directly between the players in an open field, and are not suited for palying in a three-walled court as in Jai-Alai. For this reason almost all of them incorporate a ball-cradling section or pouch adjacent to the uppermost part of the handle to enable the retention of the ball for a considerable length of time while the player is running in the field and is preparing to throw the ball to another player. This feature is totally unnecessary in a Jai-Alai cesta where a shot is required to be made within a split second of a catch in one swing of the arm.

What is needed to overcome each of the above-discussed problems and shortcomings is a Jai-Alai cesta which can be mass produced of a molded semi-flexible material or plastic, incorporating a long handle, a whip or a flexible hand securing means with finger slots, and a uniquely molded catching surface of high-impact absorbing capability without custom fit gloved portion and uncomfortable wrist strap. If a device incorporating these features could be produced there would be a simple, safe, efficient, durable, convenient, but easily affordable Jai-Alai device which practically everyone interested in Jai-Alai could use in any conventional walled court, and be able to learn the basics of the proper arm swings necessary to make a variety of shots using a hard ball in a minimal amount of time, and with minimal effort, and training. This would also standardize the cesta and allow for universal fit from player to player eliminating the need for custom made cestas. This also will put the players on equal footing, equipment wise, making jai-alai strictly a contest of skill between players. It is believed that the cesta of the present invention provides such a device.

SUMMARY OF THE INVENTION

In accordance with the illustrated embodiment, the present invention provides a ball catching and throwing apparatus which may be used for jai-alai and similar games or modifications thereof. The apparatus includes a handle affixed to a scoop for catching and throwing a ball. The scoop is formed in a large "C" shape having a pair of semiparabolic sides interconnected by a curved ramp surface which tapers into a shallow arched surface at the end of the scoop opposite the handle to form an extended lip portion. The other edges of the scoop sides are bifurcated extensions of the handle.

Alternately, the apparatus includes a handle affixed to a scoop wherein the scoop is a basket having a narrow and slender ramp starting from the handle defining a sharp curved base forming a point of deepest extent. From the point of deepest extent the radius of the arch of the ramp gradually increases to form a slightly arched top portion with its ramp surface substantially perpendicular to the longest axis of handle.

To facilitate a user being able to hold onto the handle of the above described apparatus, a whip attached to opposite ends of the handle may be provided. Such a whip includes two straps with one having a permanent loop at one end with the second strap woven through slots in both sides of the loop to provide adjustable finger sized openings.

DESCRIPTION OF THE DRAWINGS

FIG. 5 is an enlarged sectional view along line 5—5 of a portion of the article shown in FIG. 3.

FIG. 6 is an expanded sectional view along line 6—6 of a limited portion of the ball-receiving scoop 8 of the article shown in FIG. 2.

FIG. 7 is an expanded perspective view along line 7—7 of a portion of the interior of scoop 8 of the article shown in FIG. 2.

FIG. 8 is an expanded perspective view along line 8—8 of a portion of the exterior of scoop 8 of the article shown in FIG. 4.

FIG. 9 is an expanded perspective view of the whip or flexible hand-securing means with finger slots of the article as shown in FIG. 1.

DESCRIPTION OF THE PREFERRED EMBODIMENT

Figure 1:
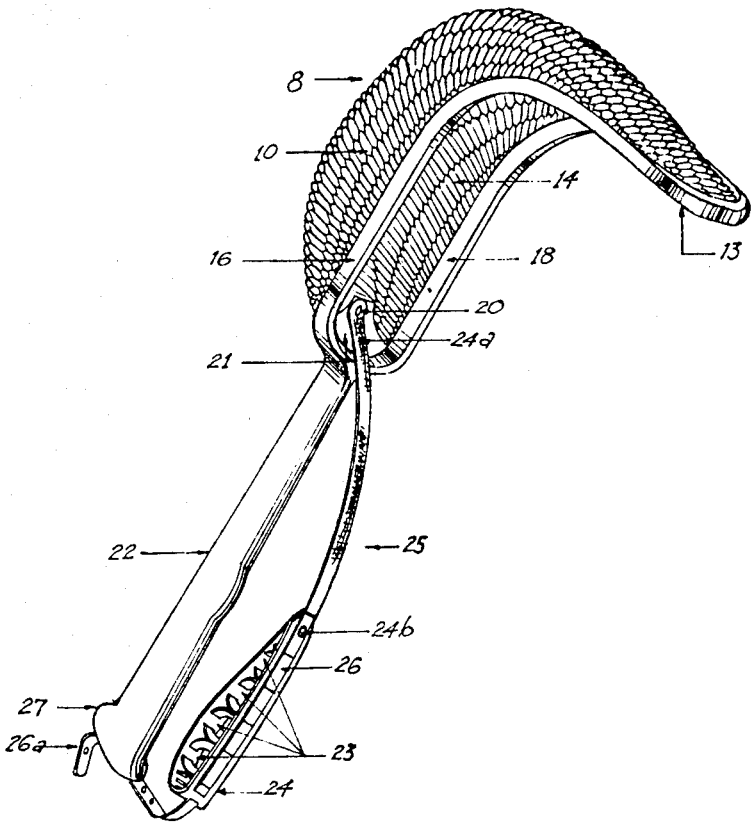
FIG. 1 is a perspective view of the cesta constructed in accordance with the present invention.
Figure 2:
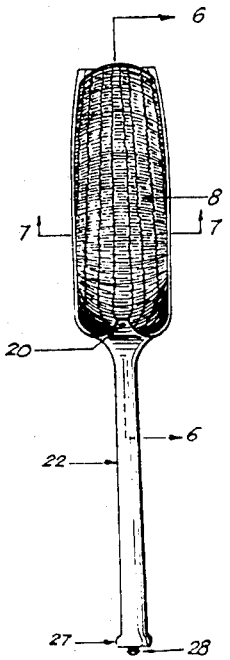
FIG. 2 is a rear elevational view of the cesta shown in FIG. 1.
Figure 3:
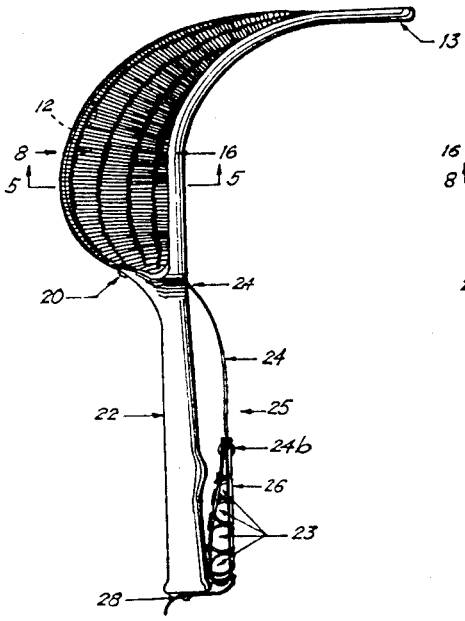
FIG. 3 is a side elevational view of the cesta shown in FIG. 1.
Figure 4:
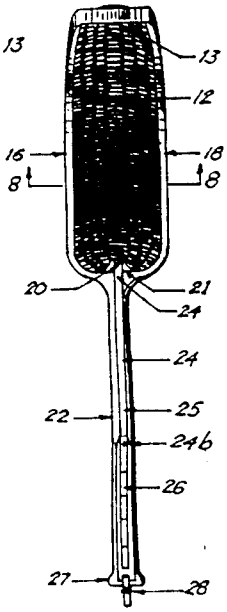
FIG. 4 is a front elevational view of the cesta shown in FIG. 1.

The drawings in FIGS. 1-4 each show a cesta, preferably injection molded from a high-impact and semi-flexible material such as plastic, which features a long handle 22 instead of a standard flat glove portion of traditional cestas. Also shown are a ball-receiving scoop 8, and a whip 25 or flexible hand-securing means used in conjunction with the handle. One end of whip 25 is fastened or riveted to the uppermost end of the handle 22 at 20, and finger slots 23 have been created in the other end nearest the bottom of handle 22 to secure the hand and for gripping convenience. The deepest portion, section 5—5 of the ball-receiving scoop 8, whose cross-section is shown in FIG. 5 has a semi-parabolic contour composed of the sides 10 and 14 connected by the inner ramp 12, which tapers into a very slightly arched surface as it approaches its tip portion 13. Also shown in FIG. 5, is the cross-section of the thick edges 16 and 18 of the ball-receiving scoop 8 which surrounds it and is integrally connected to the handle 22. The inner surface of the ball-receiving scoop 8, whose cross-sections and perspective views are shown in FIGS. 5–8, is composed of several molded columns of tiny sectional concaved but oval-shaped indentations running side by side from its base 21 to its tip portion 13. These indentations are a series of concaved semicircular arcs 10*b* and sides 10*a* protruding along the inner surface to form the ridges as shown in FIG. 6. As an option, a hole can be made at the centers of, or slots along the sides of, several of these columns of indentations composing the main ramp. The ball-receiving scoop 8 forms a narrow and slender chute that starts from the uppermost part of the handle 21 defining a very sharp curved base up to its deepest portion section 5—5, from which the arch then gradually tapers off to a slightly arched tip portion 13 whose ramp surface is almost perpendicular to the handle's vertical axis, defining a crescent-like, narrow basket as shown in FIG. 3. The handle 22 is long and slender having an oval-shaped cross-section incorporating a rivet or pin 28 in the end opposite the end to which scoop 8 is attached. One end of the whip 25 is anchorable to pin 28 at 26*a*. On the uppermost end of handle 22, which is also a part of the base of the ball-receiving scoop 8, the other end of the whip 25 is affixed by rivet 20 at 24*a*, as shown in FIG. 3. Handle 22 has a butt end 27 for additional handling convenience and narrows down to its neck, the back of which follows the shape of the sharp curvature in the base of the ball-receiving scoop 8, as shown in FIGS. 2–4. From the uppermost part of the handle, the plain and thick edges 16 and 18 of the ball-receiving scoop 8 each branches out like tines of a tuning fork arcuately bent 90 degrees forward in the middle and forming the boundary of ball-receiving scoop 8. Edges 16 and 18 serve mainly to brace and reinforce scoop 8 as shown in FIG. 4. Whip 25 is generally made of leather, or any other flexible and resilient material, including two narrow strips 24 and 26 together being approximately 26 inches long. The main member 24 is about half an inch in width over approximately 15" of its length and widens to about an inch in width on its remaining 11" of length. The other strip 26, which is softer and narrower, serves as the partitions for creating the finger slots 23 and has a uniform width throughout its length. The wider section of main member 24 is folded and its end is fastened, sewed or riveted back to itself at point 24*b*, where the wider width ends. The narrower strip 26 is either webbed through the rectangular slits provided in the loop of main member 24. Starting with one end also fastened at 24*b* strip 26 is webbed through slit 24*c* to 24*d* to 24*e*, then back to 24*c* to 24*f* to 24*g* to 24*h* and back to 24*f*, and so on, as shown in FIG. 9, or it can be sewed alternately between the inner surface of the loop portion of main member 24, to form four comfortable finger slots 23 specifically intended for the player's hand. The narrow end of main member 24 is provided with hole at 24*a* for securely riveting it to the inner base of the ball-receiving scoop 8 at point 20, or to any other convenient point in the upper part of the handle 22. The loose other end of the narrower divider strip 26, which has been provided with several center holes at 26*a* for hooking it to the rivet or pin 28 located at the bottom of the butt end 27 of handle 22 in such a manner as to permit it to freely rotate about the handle's periphery. By including a plurality of holes 26*a* permits the adjustment of the size of finger slots 23 and the length of whip 25.

Operation

The long handle 22 is mainly for gripping convenience, increased the player reach, safety, controlling the swinging direction of the cesta, adding more dimension and shot possibilities to the game, and providing a stable support base to the ball-receiving scoop 8 and its edges 16 and 18 which serves as the cesta's brace and reinforcement. Equally important is that its longer length places the ball (rotating mass) farther away from the pivotal point, which is the player's shoulder, giving a greater amount of inertia to the ball when it is projected by the player's swing. Pin 28 and the hole 20 in handle 22, serve as the anchor points for the whip 25 which secures the hand of the player to the cesta. The strip 24 of the whip 25, serves as the main member which carries the tension generated in the whip during the player's ball-projecting swing. The other strip 26, which is webbed through the slits 24*c* to 24*r* in the looped end of strip 24, creates the finger slots as shown in FIG. 9, and acts as comfortable and adjustable dividers or spacers between the fingers to facilitate fit to different sized hands. The centerholes at 26*a* of the whip, serve as the adjustment for its proper tension or looseness, determined by whatever is convenient and comfortable to the player's grip along the handle 22.

Section 5—5, which is the deepest portion of the ball's pathway along the inner ramp 12, prevents the ball from rolling out of the ball-receiving scoop 8 at 21 after the catch and serves as the starting point of the ball's trajectory, providing it with a longer running ramp to build-up sufficient initial momentum inside the ball-receiving scoop 8 giving the ball considerable speed and power before it is caromed back to the wall, in spite of the smaller size of scoop than the traditional cesta. It also provides the ball-receiving scoop 8 with additional room for catching balls having difficult, unusual and unexpected trajectories.

The tip portion 13 of scoop 8 serves as the proper entrance and the launching pad of the ball, guiding it before flight to the intended target. Since the tip portion 13 is frequently hit against the floor and walls during a game it is made thicker to lengthen the life of the cesta of the present invention. The series of concaved semicircular arcs 10*b* and sides 10*a* protruding along the inner surface of the ball-receiving scoop 8, as shown in the expanded view of FIG. 6, gives the cesta its high-impact absorbing property and its efficient ball-retention capability. Just as the ball is caught, points 10*a* act as the contact points which initially absorb the energy at impact from the speeding hard ball and readily transmit that energy to semi-circular portions 10*b*, forcing them to flex and expand several times (depending upon how many times the ball rebounds within scoop 8), thereby dissipating most of the energy of impact and slowing the ball's speed considerably, and thus, effectively preventing it from bouncing-out of the ball-receiving scoop 8. These deep protruding points 10*a*, also provide an effective mechanical means to impart the spin (english) to the ball whenever it is needed. The main body of the deepest portion 5—5 of the ball-receiving scoop 8 is formed into a semi-parabolic cross-section as shown in FIG. 5. This provides more rebounding room for the ball after it is caught and, because of the narrower entrance as defined by the edges 16 and 18, in conjunction with the molded surface's high impact-absorbing feature, helps greatly in keeping the ball from bouncing out of the ball-receiving scoop 8. As an option, a hole or slot can be made at the centers or sides of several of the columns of indentations composing the main ramp of the ball-receiving scoop 8 to allow the passage of air through its surface during the player's swings and prevent any air current build-up inside the scoop 8 which could deflect the ball's trajectory and diminish its force and speed, as well as require the player to exert more energy in each swing.

This combination offers a means by which stronger impetus is imparted to the ball when projected and at the same time minimizing the effort exerted by the player in his/her swings, mainly due to the snapping tension in the whip 25 and the improved leverage available due to the longer radius of the ball's trajectory path along the inner surface of the ball-receiving scoop 8 from the pivotal point which is the player's shoulder. These factors make the player's swing much easier without sacrificing the speed and accuracy of the player's shots. Further, an additional variety of shots and catches not available with the traditional cesta can be made by a player since he/she can grip the handle in a number of ways along and about the handle's periphery, and the long handle 22 offers a much wider margin of safety for the player. The handle 22 is designed to be long enough to put the area of the ball-receiving scoop 8 of the cesta twice as far away from the player's body during the catching action and, thereby, reducing the risk of injury to the player from the speeding hard ball. It also provides for a longer reach for catching a high flying ball.

Also, the long handle 22 offers an easier way by which most people who are already playing tennis, racquetball, or any other sports using rackets with a handle, can easily adapt to and facilitate their ability to acquire the necessary skill for the proper handling of the cesta in conjunction with the hard ball, and the combination of the long handle and the whip, or flexible hand-securing means with finger slots, offers a cesta which has a universal fit. It can be used comfortably by children, teens, adults, men or women, left-handed as well as right-handed persons, without any major alterations and custom fitting.

From the foregoing description, it will be apparent that the invention disclosed herein provides a novel and advantageous jai-alai cesta design. As will be understood by those familiar with the art, the invention may be embodied in other specific forms without departing from the spirit or essential characteristics thereof.

I claim:

1. An apparatus for catching and throwing projectiles comprising:

handle means for grasping said apparatus; and a scoop for catching and throwing said projectile, said scoop having a pair of semi-parabolic sides interconnected one with the other along one edge by a curved ramp surface which tapers into a shallow arched surface toward one end of the scoop means forming an extended lip portion, at the other end of the scoop the ramp surface continues until it joins the other edge of each of said sides, said handle means being affixed to said other end of the scoop with the other edges of each of said sides being bifurcated extensions of said handle means.

2. An apparatus as in claim 1 wherein said apparatus is injection molded from a selected high-impact semi-flexible material.

3. An apparatus as in claim 1 wherein said scoop has a cross-section at its deepest portion as shown in FIG. 5.

4. An apparatus as in claim 1 wherein the interior surface of the scoop defines adjacent and interlocking substantially oval shaped concave indentations with ridges therebetween.

5. An apparatus as in claim 4 wherein the interior surface indentations and ridges are as shown in FIG. 8.

6. An apparatus as in claim 1 further comprising whip means for securing the user's hand to the apparatus in a position to grasp the handle means, said whip means including:

first and second attachment means for attaching said whip to both ends of the handle means; and finger slot means for receiving the fingers of the user.

7. An apparatus as in claim 6 wherein:

said handle means at its point of greatest extent from the scoop includes means for removeably receiving said second attachment means of said whip means for adjusting said whip to the hand of the user; and said first attachment means of said whip means being affixed within said scoop at its intersection with said handle means.

8. An apparatus as in claim 1 further including whip means for securing a user's hand to the apparatus in a position to grasp the handle means, said whip means including:

a first strap of a flexible resilient material folded from one end to form a loop by affixing said one end to the body of said first strap;

web means between the two sides of the loop of said first strap for providing finger sized openings to receive the fingers of the user; and means for attaching the whip means to the handle means and the scoop.

9. An apparatus as in claim 8 wherein:

said first strap includes a plurality of spaced-apart slots in both sides of the loop portion;

said web means includes a second strap that is narrower than the width of the first strap in its loop portion with the second strap threaded through the slots in the loop portion of the first strap to produce said finger sized openings with one end of the second strap affixed to juncture of the body and one end of said first strap.

10. An apparatus as in claim 9 wherein: said whip attachment means includes:

first attachment means at the other end of said first strap for affixing said first strap within said scoop at its intersection with said handle means;

second attachment means at the other end of said second strap for providing attachment and adjustability of said fingersized openings; and said handle means at its point of greatest extent from the scoop includes means for removeably receiving said second attachment means.

11. An apparatus for catching and throwing projectiles comprising:

a handle means for grasping said apparatus; and a scoop affixed to the handle means for catching and throwing said projectile, said scoop forming a narrow and slender ramp starting from the handle means defining a sharp curved base to form a point of deepest extent from which the radius of the arch of the ramp gradually increases to form a slightly arched top portion with its ramp surface substantially perpendicular to the longest axis of the handle means;

wherein said handle means has cross-sectional dimensions which are substantially smaller than the width of the scoop; and wherein said scoop has an inner surface comprising interlocking rows of a plurality of identical sections, each section having two pointed ends and two oppositely opposed parallel sides connecting said two pointed ends one to the other, with each pointed end configured to exactly match and interlock with two pointed ends of the two adjacent sections in an adjacent row of sections in the manner of a honeycomb, and each parallel side forming a common side with an adjacent section in the same row, each section having a concave surface between said parallel sides and between said pointed ends.

12. An apparatus as in claim 11 wherein said apparatus is injection molded from a selected high-impact semi-flexible material.

13. An apparatus as in claim 11 wherein said scoop has a cross-section at its deepest portion as shown in FIG. 5.

14. An apparatus as in claim 11 wherein the interior surface of the scoop defines adjacent and interlocking substantially oval shaped concave indentations with ridges therebetween.

15. An apparatus as in claim 14 wherein the interior surface indentations and ridges are as shown in FIG. 8.

16. An apparatus as in claim 11 wherein said inner surface comprises a single piece of injected molded material.

17. An apparatus for catching and throwing projectiles comprising:

a handle means for grasping said apparatus;

a scoop affixed to the handle means for catching and throwing said projectile, said scoop forming a narrow and slender ramp starting from the handle means defining a sharp curved base to form a point of deepest extent from which the radius of the arch of the ramp gradually increases to form a slightly arched top portion with its ramp surface substantially perpendicular to the longest axis of the handle means; and whip means for securing the user's hand to the apparatus in a position to grasp the handle means, said whip means including:

first and second attachment means for attaching said whip to the handle means; and finger slot means for receiving the fingers of the user.

18. An apparatus as in claim 17 wherein:

said handle means at its point of greatest extent from the scoop includes means for removeably receiving said second attachment means of said whip means for adjusting said whip to the hand of the user; and said first attachment means of said whip means being affixed within said scoop at its intersection with said handle means.

19. An apparatus for catching and throwing projectiles comprising:

a handle means for grasping said apparatus;

a scoop affixed to the handle means for catching and throwing said projectile, said scoop forming a narrow and slender ramp starting from the handle means defining a sharp curved base to form a point of deepest extent from which the radius of the arch of the ramp gradually increases to form a slightly arched top portion with its ramp surface substantially perpendicular to the longest axis of the handle means; and whip means for securing a user's hand to the apparatus in a position to grasp the handle means, said whip means including:

a first strap of a flexible resilient material folded from one end to form a loop by affixing said one end to the body of said first strap;

web means between the two sides of the loop of said first strap for providing finger sized openings to receive the fingers of the user; and means for attaching the whip means to the handle means and the scoop.

20. An apparatus as in claim 19 wherein:

said first strap includes a plurality of spaced-apart slots in both sides of the loop portion;

said web means includes a second strap that is narrower than the width of the first strap in its loop portion with the second strap threaded through the slots in the loop portion of the first strap to produce said finger sized openings with one end of the second strap affixed to juncture of the body and one end of said first strap.

21. An apparatus as in claim 20 wherein: said whip attachment means includes:

first attachment means at the other end of said first strap for affixing said first strap within said scoop at its intersection with said handle means;

second attachment means at the other end of said second strap for providing attachment and adjustability of said fingersized openings; and said handle means at its point of greatest extent from the scoop includes means for removeably receiving said second attachment means.

22. An apparatus as in claim 1 wherein said scoop has an inner surface comprising interlocking rows of a plurality of identical sections, each section having two pointed ends and two oppositely opposed parallel sides connecting said two pointed ends one to the other, with each pointed end configured to exactly match and interlock with two pointed ends of the two adjacent sections in an adjacent row of sections in the manner of a honeycomb, and each parallel side forming a common side with an adjacent section in the same row, each section having a concave surface between said parallel sides and between said pointed ends.

23. An apparatus as in claim 22 wherein said inner surface comprises a single piece of injected molded material.

* * * * *